US006401764B1

(12) United States Patent
Bell, Jr.

(10) Patent No.: US 6,401,764 B1
(45) Date of Patent: Jun. 11, 2002

(54) GRIPPER FOR STRAPPING MACHINE

(75) Inventor: Lemuel J. Bell, Jr., Gurnee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/536,822

(22) Filed: Mar. 27, 2000

(51) Int. Cl.[7] ..... B21F 9/02
(52) U.S. Cl. ..... 140/93.2
(58) Field of Search ..... 140/93.2, 93.4, 140/123.5, 123.6; 254/257; 24/680, DIG. 22

(56) References Cited

U.S. PATENT DOCUMENTS

| | | | |
|---|---|---|---|
| 1,989,669 | A | 2/1935 | Harvey |
| 2,040,576 | A | 5/1936 | Timmerbeil |
| 2,324,609 | A | 7/1943 | Watt et al. |
| 2,549,626 | A | 4/1951 | Mosey |
| 3,791,420 | A | 2/1974 | Beach |
| 4,791,968 | A | 12/1988 | Pearson |
| 4,825,512 | A | 5/1989 | Tremper et al. |
| 4,953,599 | A | 9/1990 | Kato |
| 5,097,874 | A | 3/1992 | Bobren |

*Primary Examiner*—Lowell A. Larson
(74) *Attorney, Agent, or Firm*—Donald J. Breh; Mark W. Croll; Lisa M. Soltis

(57) ABSTRACT

A strapping machine for positioning an associated strap material around an associated load and tensioning the strap material around the load, the strap having a width, the strapping machine comprising a frame for supporting the load, a chute positioned on the frame for receiving the strap material and orienting the strap material around the load, a strap supply, and a strapping head. The strapping head extracts the strap from the supply, feeds the strap through the chute around the load, passes the strap from the chute around the load, retracts and tensions the strap, and seals the strap to itself. The strapping head includes a plurality of sealing elements and a gripper. The gripper is positioned at an upstream location from the plurality of sealing elements. The gripper has a floating element and a stationary element. The floating and stationary elements each include base surfaces. A plurality of teeth extend from one of the floating and stationary elements and a plurality of channels is formed in the other of the elements. The teeth and the channels are configured to secure the strap therebetween when the gripper is actuated, such that when the gripper is actuated, the teeth, in conjunction with the channels, form substantially centrally located, localized deformations in the strap extending across a portion of the strap width.

4 Claims, 2 Drawing Sheets

GRIPPER FOR STRAPPING MACHINE

FIELD OF THE INVENTION

This invention pertains to a gripper for a strapping machine. More particularly, this invention pertains to a gripper for use in the strapping head of a strapping machine for steel strapping material.

BACKGROUND OF THE INVENTION

Strapping machines are well-known in the art. There are two principle types of strapping machines. One type of strapping machine positions and tensions a steel strap around a load to bundle or secure the load to, for example, a pallet.

A typical strapping machine includes a frame-like support for the overall machine, a working area to, for example, support a load, a strapping head, a chute around which the strap is fed and one or more dispensers for dispensing the strap material to the strapping head.

The strapping head pulls the strap material from the dispensers, and feeds it around the chute until a leading portion of the strap returns to the strapping head. At the strapping head, the leading portion or leading end is gripped and the trailing portion or end of the strap is retracted and tensioned to provide an appropriate compression on the strapped load. The strap is then sealed to itself in an overlapping manner, the trailing end portion is severed and the load removed from the machine.

The strapping head thus serves a number of functions. These functions and the general arrangements of strapping heads are provided in U.S. Pat. No. 4,791,968 to Pearson, U.S. Pat. No. 4,825,512 to Tremper et al. and U.S. Pat. No. 5,097,874 to Bobren. These patents, which are assigned to the assignee of the present invention, are all incorporated herein by reference. Two principle functions of the strapping head are to grip the leading end of the strap as it returns from around the chute and to seal the strap material to itself.

Strapping material is manufactured from a variety of materials in a variety of sizes. The ranges of sizes include both the width of the strap as well as the gauge or thickness of the strap.

In known strapping heads, the effectiveness of the gripper, that is that portion of the machine that grips the leading end of the strap while the strap is tensioned, sealed to itself and cut, is greatly dependent upon either or both the width and the gauge of the strap material. To this end, as strap material is changed, such as when a new source of strap material is supplied from a dispenser, adjustments must often be made to the gripper so that it can provide an appropriate force on the strap for the strapping head to properly carry out its remaining functions. In some known grippers, the strap is engaged at the strap edges. To this end, use of the gripper is almost wholly dependent upon the width of the strap material.

In other gripping arrangements, the gripper is dependent upon the gauge of the strap material and shim may be required at the gripper to compensate for strap gauge changes. Regardless of the type of gripper, consideration must be given to the force exerted on the strap so that the integrity of the strap is not compromised, such as by cutting into the strap material during gripping.

Moreover, attempts have been made to design strapping heads with gripper portions that can be separated from one another, such as on a pivotal frame, so that maintenance can be carried out on the strapping head. However, these attempts at design have been unsuccessful in designing an effective strapping head gripper in which the portions can separate from one another and which can accommodate varying gauges of strap material.

Accordingly, there exists a need for a gripper arrangement that can be mounted to a strapping head having pivotal portions for ready access to the strapping head, and which can accommodate varying gauges and widths of strapping material.

SUMMARY OF THE INVENTION

A strapping machine positions an associated strap material around an associated load and tensioning the strap material around the load. The strap for use with the machine has a width. The strapping machine includes a frame for supporting the load, a chute positioned on the frame for receiving the strap material and orienting the strap material around the load, and a strap supply.

A strapping head extracts the strap from the supply, feeds the strap through the chute around the load, passes the strap from the chute around the load, retracts and tensions the strap, and seals the strap to itself The strapping head includes a plurality of sealing elements and a gripper. The gripper grips and holds the strap material as it is tensioned and sealed to itself.

The gripper is positioned at an upstream location from the plurality of sealing elements. The gripper has a floating element and a stationary element. Each the floating and stationary elements includes a base surface. A plurality of teeth extend from one of the floating and stationary elements and a plurality of channels is formed in the other of the floating and stationary elements. In a preferred embodiment, the teeth extend from the stationary element and the channels are formed in the floating element.

Most preferably, each the floating and stationary elements is formed having a base portion or surface that defines a plane. In a preferred embodiment, the base surface planes are parallel to one another and are oriented at an angle of about 15 degrees relative to the pathway through the strapping head through which the strap material traverses. The teeth and channels are configured to secure the strap therebetween when the gripper is actuated such that when the gripper is actuated, the teeth, in conjunction with the channels, form substantially centrally located, localized deformations in the strap extending across a portion of the strap width.

Most preferably, the gripper assembly includes two teeth and two channels, with each tooth corresponding to a respective channel. The teeth include a gripping face formed at an angle of about 75 degrees (i.e., about 15 degrees from perpendicular) relative to the direction of travel of the strap through the strapping head.

Other features and advantages of the present invention will be apparent from the following detailed description, in conjunction with the appended claims.

DETAILED DESCRIPTION OF THE PREFERRED EMBODIMENTS

Figure 1:
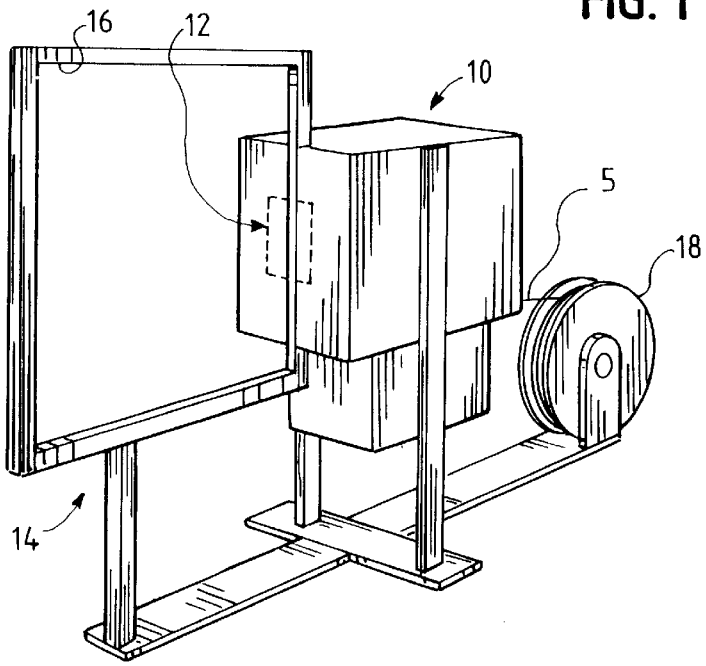
FIG. 1 is a perspective view of an exemplary strapping machine incorporating a strapping head in accordance with the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

Referring now to the figures and in particular, FIG. 1, there is shown an exemplary strapping machine 10 having a strapping head 12 embodying the principles of the present invention. The strapping machine 10 includes a frame 14 that may include a work surface (not shown) for supporting a load to be bundled or strapped. The strapping machine 10 includes a chute 16, the strapping head 12, and one or more dispensers 18 from which strap material S is fed to the strapping head 12.

The strapping head 12 is that portion of the machine 10 that extracts strap material S from the dispensers 18, feeds the strap S around the chute 16 and accepts a leading end L of the strap S as it is fed around the chute 16. Strapping heads carrying out these, as well as other functions, are disclosed in the aforementioned Pat. Nos. 4,791,968 to Pearson, 4,825,512 to Tremper et al. and 5,097,874 to Bobren.

As the strapping head 12 feeds the strap material S around the chute 16, the material that returns to the strapping head 12 and is secured by the head 12 for sealing is referred to as the leading end L, and that portion of the strap material that resides within the strapping head 12 when the leading end L returns to the head 12 is referred to as the trailing end portion T.

Once the leading end L returns to the strapping head 12, it must be gripped so that the trailing end T can be tensioned accordingly to bundle or compress the load. A gripper assembly 20 in accordance with the present invention is positioned immediately upstream of sealing heads or elements 22 in the strapping head 12.

Figure 2:
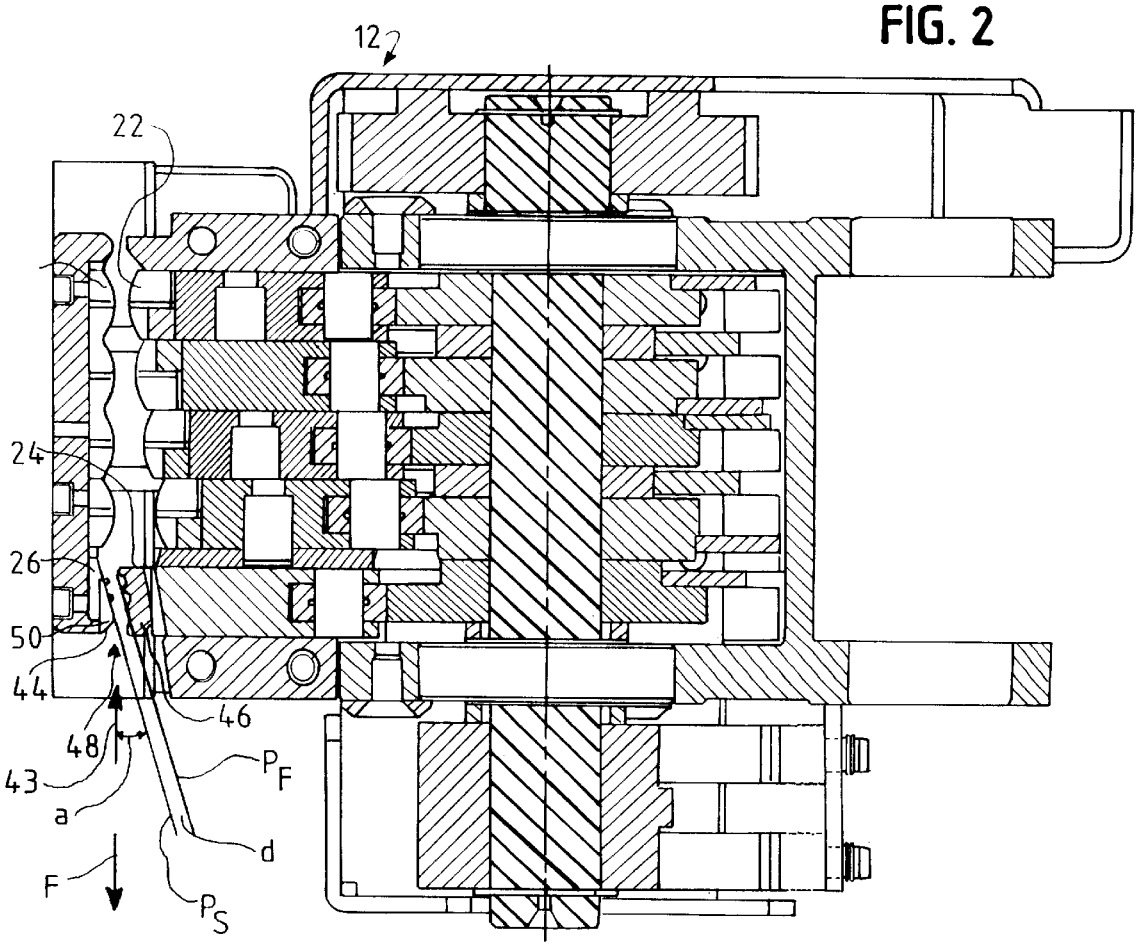
FIG. 2 is a partial cross-sectional view of a strapping head showing the sealing elements and the gripper mounted at an inlet or upstream side of the sealing elements.
Figure 3:
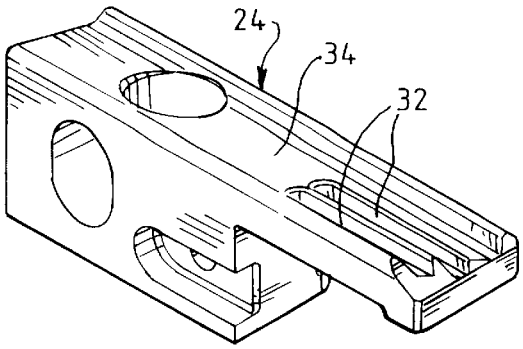
FIG. 3 is a perspective view of a floating gripper element showing the pockets or channels formed therein.

Referring now to FIG. 2, the gripper assembly 20 is shown positioned relative to the sealing elements 22. The gripper assembly 20 includes a first floating gripper element 24 and a second stationary gripper element 26. The floating gripper element 24 is mounted on a stationary portion of the strapping head 12, while the stationary gripper element 26 is mounted on a moving portion of the strapping head 12. The "moving portion" is that portion of the head 12 that has the moving sealing elements 22 mounted therein. As will be recognized by those skilled in the art, in order for the strap S to be sealed, one or more elements must move into contact with the strap, thus the "moving" portions or sealing elements 22. In addition, the strapping head 12 can be configured so that it pivots to, for example, open to permit access to the internal regions of the head 12.

The gripper elements 24, 26 cooperate with one another to secure the leading end L of the strap S within the strapping head 12 as the strap S is tensioned and sealed onto itself. The stationary gripper element 26 is configured having a plurality of teeth-like projections 28 extending upwardly from a base surface 30 thereof The floating gripper element 24 includes a plurality of channels or pockets 32 formed in a base surface 34 that are complementary to the stationary portion teeth 28.

Figure 7:
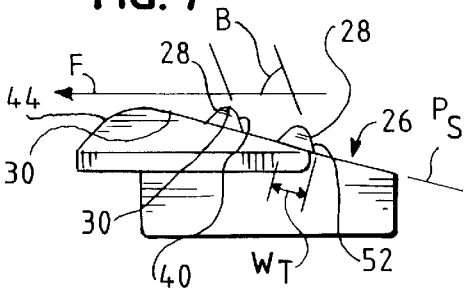
FIG. 7 is a side view of the stationary element illustrating a profile of the gripping teeth.
Figure 4:
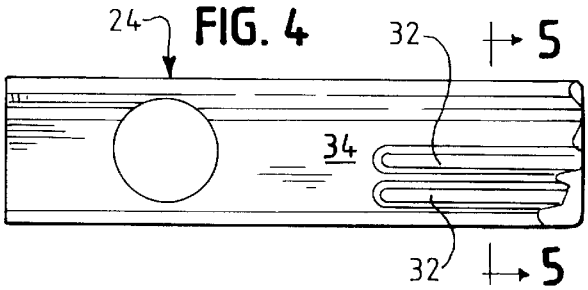
FIG. 4 is a top view of the floating gripper element of FIG. 3.
Figure 5:
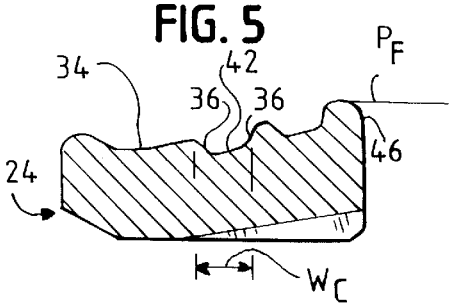
FIG. 5 is a cross-sectional view of the floating gripper element taken along line 5—5 of FIG. 4.
Figure 6:
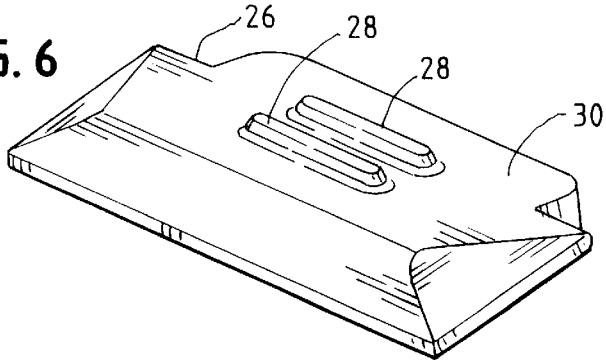
FIG. 6 is a perspective view of the stationary gripper element illustrating the gripper teeth.

Referring to FIGS. 5 and 7, the channels are formed having a width $w_c$ that is greater than the width $w_t$ of the teeth 28. In this configuration, the sides 36 of the channels 32 accommodate the strap S as it curves or serpentines between the apex 38 and sides 40 of the teeth 28 and the bottom 42 and sides 36 of the channels 32.

As can be seen from FIG. 7, the base surface 30 of the stationary gripper portion 36 defines a plane $P_s$. Likewise, as seen in FIG. 5, the base surface 34 of the floating gripper element 24 defines a plane $P_f$. Referring now to FIG. 2, the floating element plane $P_f$ is substantially parallel to and is spaced from the stationary gripper base plane $P_s$. These planes $P_f$, $P_s$ are formed at an angle $\alpha$ to a pathway, indicated at 43, for the leading end L of the strap S as it traverses through the strapping head 12.

As seen in FIG. 2, forward ends 44, 46 of the floating and stationary gripper elements 24, 26 define an entrance, as indicated at 48 for the leading end L of the strap. This entrance 48 is somewhat larger than the distance d between the base planes $P_f$, $P_s$ and thus provides a "window" for the strap S as the leading end L enters the strapping head 12. The entrance 48 can be formed as arcuate wall sections, as indicated at 50, to further facilitate entry of the leading end L.

From the entrance 48, the pathway 43 through the gripper 20 narrows and turns as the strap material S approaches the teeth 28 and complementary channels 32. This turn defines the offset angle $\alpha$ of the base surface planes 30, 34 relative to the pathway 43 direction. Preferably, the angle $\alpha$ is about 15 degrees. To this end, when the strap is tensioned, it is tensioned in a direction that is offset relative to the base planes 30, 34 by the angle $\alpha$.

Referring now to FIG. 7, there is shown a side view of the stationary gripper portion along with an illustration of the pathway 43 direction which is opposite to the direction of force F on the strapping S material when it is placed in tension. The teeth 28 of the floating gripper portion are formed such that they each include first and second surfaces 52, 54. The teeth 28 can be formed substantially identical to one another. When positioned in the strapping head 12, and with the strap S traversing through the gripper 20, the gripping surfaces 52 of the teeth 28 define an angle $\beta$ of about 75 degrees relative to the direction of force F.

Figure 8A:
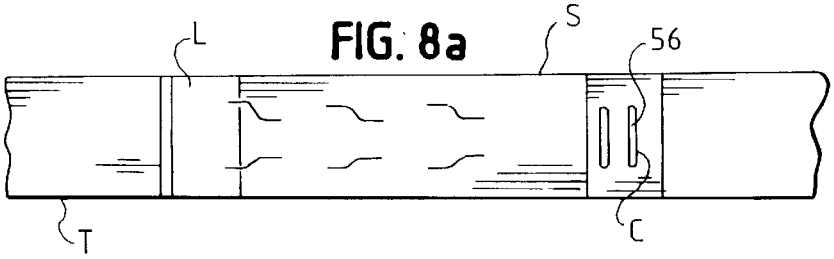
FIGS. 8*a* and 8*b* illustrate a portion of metal strapping material having a seal formed therein and showing the localized deformation resulting from use of the present gripper, FIG. 8*a* being a top view of the strapping material and FIG. 8*b* being a side view of the strapping.
Figure 8B:
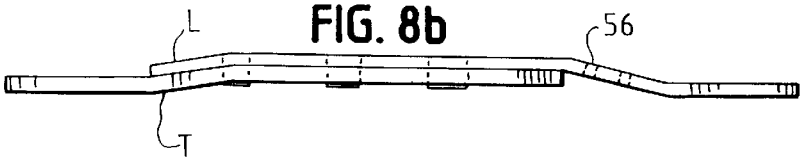

As will be recognized by those skilled in the art, the present gripper 20 provides a number of advantages over known gripping arrangements. First, referring to FIGS. 8*a* and 8*b*, because the strap S is gripped at about a central location C along the width of the strap S, the gripper 20 is generally insensitive to strap width. That is, the present gripper can be used with strap material having varying widths, generally, without adjustment. In addition, because of the floating gripper 24 arrangement, the gripper assembly

20 is also generally not sensitive to the gauge or the thickness of the strap material S. As such, unlike known strapping head grippers, the present gripper 20 does not require undo adjustment in order to properly function with a variety of strap materials.

Another advantage enjoyed by the present gripper 20 is that the deformations, indicated at 56, that are formed in the strap S are localized and do not overstress the strap material. Many known grippers locally overstress the strap, particularly at the edges where these grippers engage the strap, which results in a weakened area of the strap. The present gripper 20 locally deforms, rather than cuts into the strap material, thus not compromising the integrity of the strap. In addition, the present configuration, which provides a space or gap between the teeth 28 and channel 32 walls when the gripper 20 engages the strap material S, along with the centralized, localized deformations 56, minimizes or eliminates the opportunity to cut into the strap material during gripping. Thus, again, the integrity or strength of the strap material S is not compromised as a result of the gripper 20 engaging the strap S. Moreover, because the gripping location and thus the deformations 56 extend only along a portion of the width of the strap S, this too results in reducing or eliminating the opportunity to compromise the integrity of the strap.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. In a strapping head for use in a strapping machine for positioning and tensioning an associated strap material around a load and sealing the strap material to itself, the strapping head defining a pathway therethrough, a gripper assembly for gripping a leading end of the strap material comprising:

a floating gripping element having a base portion defining a base plane, the floating gripper element having a plurality of channels formed in the base portion; and a stationary gripping element having a base portion defining a base plane, the stationary gripper element having a plurality of teeth formed therein extending from the base portion, each of the plurality of teeth corresponding to one of the channels of the floating gripper portion, wherein the stationary gripper portion base plane and the floating gripper portion base plane are substantially parallel to one another and wherein the base planes are oriented at an angle of about 15 relative to the pathway through the strapping head along which the strap material traverses.

2. The gripper assembly in accordance with claim 1 wherein the teeth extend from the stationary element and wherein the channels are formed in the floating element.

3. The gripper assembly in accordance with claim 1 including two teeth and two channels, each tooth corresponding to a respective channel.

4. The gripper assembly in accordance with claim 1 wherein the teeth include a gripping face formed at an angle of about 75 degrees relative to the pathway through the strapping head along which the strap material traverses.

* * * * *